US010106309B2

(12) United States Patent
Hermans et al.

(10) Patent No.: US 10,106,309 B2
(45) Date of Patent: Oct. 23, 2018

(54) HANDHELD APPLICATOR SUITABLE FOR GUN VALVE CONTAINERS

(75) Inventors: Marc Hermans, Leopoldsburg (BE); Peter Geboes, Aartselaar (BE); Bart Vervoort, Poederlee (BE); Erik De Groof, Wilrijk (BE)

(73) Assignee: Soudal, Turnhout (BE)

( * ) Notice: Subject to any disclaimer, the term of this patent is extended or adjusted under 35 U.S.C. 154(b) by 293 days.

(21) Appl. No.: 13/880,074

(22) PCT Filed: Oct. 18, 2011

(86) PCT No.: PCT/EP2011/068203

§ 371 (c)(1),
(2), (4) Date: Sep. 3, 2013

(87) PCT Pub. No.: WO2012/052449

PCT Pub. Date: Apr. 26, 2012

(65) Prior Publication Data

US 2013/0334260 A1 Dec. 19, 2013

(30) Foreign Application Priority Data

Oct. 18, 2010 (EP) ..... 10187929

(51) Int. Cl.
*B65D 83/16* (2006.01)
*B65D 83/20* (2006.01)
(Continued)

(52) U.S. Cl.
CPC ..... *B65D 83/16* (2013.01); *B65D 83/206* (2013.01); *B65D 83/22* (2013.01); *B65D 83/226* (2013.01);
(Continued)

(58) Field of Classification Search
CPC .... B65D 83/205; B65D 83/206; B65D 83/22; B65D 55/02; B65D 83/40; B65D 83/46; B65D 83/06; B65D 83/226; B65D 83/303
(Continued)

(56) References Cited

U.S. PATENT DOCUMENTS 3,580,432 A * 5/1971 Brooks ..... 222/402.13
4,171,758 A * 10/1979 Corba ..... 222/402.11
(Continued)

FOREIGN PATENT DOCUMENTS

| | | |
|---|---|---|
| EP | 0850852 | 7/1998 |
| JP | 8169480 | 7/1996 |
| WO | WO 2009147250 | 12/2009 |

OTHER PUBLICATIONS

Aster De Schrijver, Handboek Schuim—Polyurethaanschiumsystemen voor vakman en doe-het-zelver. Leading Pages of the book showing Table of Contents. Copyright 1986, Grossmatt 6, CH-6052 Hergiswil.

(Continued)

*Primary Examiner* — Charles P Cheyney
(74) *Attorney, Agent, or Firm* — Jerold I. Schneider; Schneider Rothman Intellectual Property Law Group, PLLC

(57) ABSTRACT

An improved handheld applicator is provided, fitted into an assembly onto a pressure container which is equipped with a gun valve and containing a viscous compound suitable for forming a silicone paste, a polyurethane (PU) foam, or a glue, the applicator being producible in one single injection molding step and providing in handheld use the ergonomics, the aiming and the dosing accuracy comparable to the use of the pressure container with a dispensing gun. Further provided is a process for the production of the applicator and of the assembly, as well as the use of the assembly for applying
(Continued)

a compound from the pressure container with a handheld method.

34 Claims, 5 Drawing Sheets

(51) Int. Cl.
*B65D 83/22* (2006.01)
*B65D 83/30* (2006.01)
*B65D 83/40* (2006.01)

(52) U.S. Cl.
CPC ..... *B65D 83/303* (2013.01); *B65D 83/40* (2013.01); *Y10T 29/49826* (2015.01)

(58) Field of Classification Search
USPC ..... 222/182, 153.11, 402.13, 402.17, 402.11
See application file for complete search history.

(56) References Cited

U.S. PATENT DOCUMENTS 5,147,075 A * 9/1992 Regan ..... F17C 7/00 222/402.15
5,549,228 A * 8/1996 Brown ..... B65D 83/207 222/402.1
5,975,377 A * 11/1999 McGowens ..... 222/402.13
6,152,335 A * 11/2000 Stern ..... B05B 1/02 222/394
6,588,631 B2 * 7/2003 Sanchez ..... 222/402.13
7,025,232 B2 * 4/2006 Green ..... 222/321.7
7,204,393 B2 * 4/2007 Strand ..... 222/402.13
7,690,528 B2 * 4/2010 Last ..... 220/787
7,984,834 B2 * 7/2011 McBroom ..... B65D 83/14 222/402.1
8,251,255 B1 * 8/2012 Greer, Jr. ..... B65D 83/30 222/1
8,905,273 B2 * 12/2014 de Schrijver ..... B65D 83/201 222/402.1
9,156,042 B2 * 10/2015 Hanson ..... B05B 1/30
9,446,894 B2 * 9/2016 Martz ..... F16K 31/58
2007/0023457 A1 * 2/2007 O'Toole et al. ..... B65D 83/206 222/402.13
2008/0035638 A1 * 2/2008 Burghaus ..... B65D 83/206 220/212
2008/0073384 A1 * 3/2008 Lin ..... 222/533
2009/0283609 A1 11/2009 Strand
2009/0321381 A1 12/2009 Paas et al.
2010/0059551 A1 * 3/2010 Tomkins et al. ..... 222/402.13
2010/0147904 A1 6/2010 Kendall
2011/0220685 A1 * 9/2011 Lind ..... B65D 83/206 222/402.11
2013/0062369 A1 * 3/2013 Engel ..... B65D 83/201 222/402.15
2014/0048568 A1 * 2/2014 Demey ..... B65D 83/202 222/402.22

OTHER PUBLICATIONS

Aster De Schrijver, Handboek Schuim—Polyurethaanschiumsystemen voor vakman en doe-het-zelver. p. 19. Copyright 1986, Grossmatt 6, CH-6052 Hergiswil.
Aster De Schrijver, Handboek Schuim—Polyurethaanschiumsystemen voor vakman en doe-het-zelver. pp. 13, 20, 49, 59, 60 and 67-71. Copyright 1986, Grossmatt 6, CH-6052 Hergiswil.
Aster De Schrijver, The Foam Manual—Polyeurethane Foam Systems for Professionals and DIY. Leading pages, Table of Contents, pp. 18-23, 80 and 81. Copyright 1986, Grossmatt 6, CH-6052 Hergiswil (Switzerland).

* cited by examiner

HANDHELD APPLICATOR SUITABLE FOR GUN VALVE CONTAINERS

CROSS-REFERENCE TO RELATED APPLICATIONS

This application is the entry into the United States of PCT Application No. PCT/EP2011/068203 filed Oct. 18, 2011 and claims priority from European Patent Application No, EP 10187929.4 filed Oct. 18, 2010, the entirety of each of which are hereby incorporated by reference.

FIELD OF THE INVENTION

The current invention relates to containers, cans or canisters containing a compound under pressure which is a high viscosity composition suitable for forming a silicone paste, a polyurethane (PU) foam, or a glue, in particular disposable containers, primarily those which are equipped with a gun valve such that the container may be coupled to a device, typically called a dispensing gun, for applying the compound. The compound is usually reactive or curable, may thus comprise one or more active components, and is suitable to form for example a sealant (e.g. a silicone paste), a polyurethane (PU) foam, or a two component glue. The invention is particularly concerned with providing an improved handheld applicator for enabling also a safe and convenient handheld use for such gun valve containers.

BACKGROUND OF THE INVENTION

Containers under pressure, containing compounds such as pastes, foams or glues, find increasing use in the building industry as well as in do-it-yourself (DIY) activities. These containers are usually disposable pressure containers, closed off by a relatively simple valve but which needs to withstand the significant pressures which may occur inside the container.

The containers itself are typically made of metal and are usually cylindrical in shape. The bottom is usually formed by a plate flanged to the cylinder and typically is concave for better withstanding the internal pressure while maintaining the ability for the container to stand upright on a flat surface. The top is usually provided with a container head, also flanged to the cylinder, and which is typically convex for the same reason of higher pressure resistance. A filling opening is usually provided centrally in the cylinder head. When preparing the container for the market, the empty container is typically filled with the compound through this central filling opening in the head, which subsequently may be closed off by flanging the container valve into the filling opening. Many compounds may be filled into the container under atmospheric pressure, and a higher pressure may subsequently be built up or introduced into the container, usually after it is closed off as described. An example wherein pressure builds up after closing the container are the compounds for polyurethane foam, in particular the one-component-foam (OCF), in which, after filling the container, an exothermic chemical reaction between the compounds may be initiated, such as by shaking the container, and the reaction produces heat and builds up pressure by the chemical production and/or the vaporisation of propellants. Propellants for building up the pressure may also be introduced at the moment of filling the container, such as a cold liquid which then is allowed to vaporise after closing the container.

Generally two types of applicators are used in current practice. Occasional and DIY users typically prefer a simple handheld applicator, usually also disposable, which is typically screwed onto the stem of the valve of the container and usually comprises a hose or tube for guiding the flow of the compound to its intended location (also called "a straw"), and a tilting adaptor or lever. The container valves for such handheld applicators comprise a threaded stem onto which the applicator is screwed, and may be referred to as "straw valves". Such handheld applicators are characterised in that they do not themselves contain a valve for stopping or controlling the flow of compound, but act on the valve provided on the container for those purposes. Consequently, any compound having passed the container valve and entered the handheld applicator is exposed to the atmosphere and, if susceptible, may react further and convert into its ultimate and usually rigid consistency. For these reasons, these adaptors are simple in design and production, cheap, but most often only useable once, and thus disposable. Typically an action on the tilting adaptor or lever provided as part of the handheld applicator results in a tilting of the stem of the container valve, such that one or more openings in the valve stem are set at least partially free into the container contents, thereby opening the straw valve. The assembly is such that the user may hold the container while pushing the lever of the handheld applicator, which provides a rough means for controlling and dosing the compound flow. U.S. Pat. No. 4,165,825 discloses suitable valves for such handheld applications. The compound dosing with such handheld systems is however rather inaccurate, and such a system is therefore more suitable for filling large crevices or cavities, such as those wider than 2 cm.

A variety of handheld applicators are known in the art. All these applicators connect onto the straw valve via a screw connection with the screw thread section which is always provided on the valve stem of a straw valve, and open the valve by tilting the valve stem. They are therefore specific and only suitable for containers equipped with a straw valve. They therefore retain the disadvantage that the dosing of the compound remains difficult to predict and control, e.g. because the position of the side openings at the bottom of the stem is unpredictable with respect to the direction of tilting. These handheld applicators typically only foresee a handle for tilting the valve stem by pushing the handle with the fingers of the hand, and require that the palm of the hand acts on the container itself. The disadvantage with such systems is that during the action of the hand, the connecting attachment between the applicator and the container is strained, and usually in a direction which creates a risk that the attachment would release and create a risk for unintentional release of compound.

The more intensive users, such as professionals or more experienced DIY users, typically prefer a more sophisticated dispensing device, such as a dispensing gun, for applying the compound such as a foam compound. With such dispensing devices, the user holds and manipulates the device or dispensing gun, with the compound container being attached to the gun. Such guns are characterised in that they comprise their own valve, preferably a needle valve for higher accuracy and better closure, for stopping or controlling the flow of compound, and this valve is usually located at the tip of the gun barrel and much more sophisticated than the container valve. It typically allows for a much better control of the compound flow as compared to the container valve. Because the control valve of the gun is located at the tip of the barrel, the compound inside the dispensing gun remains under pressure and sealed from the atmosphere. After use, there remains thus little to no volume of compound which has been exposed to the atmosphere and may react, become rigid and impair the operation of the gun during a subsequent use. Compound inside the gun may only become exposed to the atmosphere for the short time required for exchanging a container on the dispensing gun. This time is usually short, and the dispensing gun is typically used immediately after the exchange, such that the compound inside the dispensing gun is refreshed and after use this new compound remains under pressure and fresh in its fluid state. These dispensing guns are usually more complex and expensive and are typically reused several times after replacing the previous empty container with a fresh and full one. The use of these dispensing guns is more comfortable for the user, and allows a higher accuracy and dosing in the application of the compound than the handheld system. Dispensing guns are therefore also preferred for filling up smaller crevices, such as those smaller than 2 cm wide. The higher dosing accuracy allows working with less excess compound, which usually needs to be removed later and ends up as waste. This reduces the amount of aftercare work required and brings a higher efficiency in material use. Both these advantages are of high interest to the professional or intensive user.

Containers intended for the intensive user are for this purpose conveniently provided in an assembly with a first coupling piece, usually made from a plastic material, which makes the container suitable for attachment to the dispensing gun or dispensing device, and which matches with a connection element integrated in the dispensing gun, or with a second coupling piece which is attached to the dispensing gun, also called a gun adaptor, usually made of metal, such as aluminium or bronze, for making the coupling with the dispensing device or dispensing gun. A suitable foam dispensing gun is for instance disclosed in U.S. Pat. No. 5,271,537, whereby the device comprises a screw connection into which a container may be screwed which has a suitable screw connection, usually by means of a suitable coupling piece on the container. A particularly convenient first coupling piece for such screw connections is disclosed in our co-pending European patent application EP-A-10164924.2, filed 4 Jun. 2010. Instead of a screw connection, the container and the dispensing gun may be connected by means of an even more convenient and safe bayonet type coupling, also called the "Click & Fix" coupling, as described in WO 98/43894. An improved first coupling piece for such Click & Fix coupling is disclosed in our co-pending European patent application EP-A-10164927.5, filed 4 Jun. 2010.

The containers itself, which are intended for the intensive use with a dispensing gun, are closed with a different type of valve, also known as a gun valve in order to differentiate it from the so-called straw valve described above, and which is more suitable for this type of use. The gun valve does not comprise the threaded section which the straw valve requires for screwing the handheld adaptor onto its valve stem. Many gun valves are also not made for being tilted. The gun valve is constructed for, by coupling the container to the gun, being fully opened by pushing the stem of the valve down into the container contents, thereby providing as much opening as possible for a relatively minor movement of the stem. Another difference between the two types of valves is that the straw valve is provided with an extended stem, provided with a screw thread section for screwing on the handheld applicator. This connection between the stem of the straw valve and the corresponding handheld applicator needs to be sufficiently strong such that it allows passing on the force of an action on the handheld applicator such that the straw valve is tilted and thereby opened. Gun valves are not designed for being tilted, and are thus not provided with a stem extension or with a screw thread section. Consequently, straw valve containers cannot be used with equipment designed for gun valve containers. Gun valves are designed for being opened by pushing the stem down into the container, by a movement along the axis of symmetry of the valve stem.

Due to the different valves used for closing off the containers, the container or canister intended for use with the dispensing gun is thus typically different from the container intended for handheld use, i.e. with a handheld applicator. Consequently the supply chain has been carrying two types of containers having different designs, one designed for use with the dispensing gun, i.e. gun valve containers, and the other for use with the handheld applicator, i.e. straw valve containers. Also the handheld applicators are specifically made to work with the straw valve. The screw thread connection is incompatible with gun valves, and the known handheld applicators designed for straw valve containers are unable to operate on a gun valve container.

There has therefore been a need for a handheld applicator which would be suitable for use with the gun valve container, i.e. a container intended for use with the dispensing gun, and which for that purpose has been closed with a gun valve.

WO 2007/112758 discloses a handheld applicator which may be fastened onto the valve stem of a conventional gun valve. The handheld applicator may be "clicked" directly on the valve-stem. By pushing a lever provided as part of the handheld applicator, the valve stem is tilted and the valve is opened. The difficulty with this design is that fastening of the handheld applicator onto or off the valve stem needs to be performed very carefully, as any unintentional tilting of the valve during this operation would cause premature and unintentional spillage of compound, and any damage to the valve may create a safety hazard.

US 2007/0181610 A1 discloses a handheld applicator which is suitable for being snapped onto the flange around a gun valve. In one embodiment, illustrated by FIGS. 3 and 4 in US 2007/0181610 A1, the applicator is provided with a holding ring having a circumferential groove which may be pressed onto the crimping lip of the can dome, i.e. onto the flange which connects the container valve, or more precisely the valve plate thereof, with the container head. This flange connection is formed by shrinking the container valve onto the container head, thereby typically also closing off the container after it has been filled. The disclosed applicator is further provided with a safety plate, preventing an inadvertent opening of the valve until the safety plate is broken off from the applicator. One drawback with this proposal is that the assembly of the applicator with the container provides the same ergonomics of a conventional handheld applicator assembly during use. A further drawback is that removal of the safety plate is irreversible. Once broken off, the security against inadvertent opening cannot be reinstalled. Another drawback is that the handheld applicator of US 2007/0181610 A1 does not comprise a compartment for storing e.g. protecting gloves, useful for the user for protecting his hands against contact with the container content.

WO 2009/147250 discloses another handheld applicator for use with gun valve containers having different dimensions. This applicator is an assembly of at least 3 individual pieces, i.e. the housing, the adapter, a connection piece, and the handle. During operation the adapter displaces vertically and needs to provide a seal with the top of the valve stem. The adapter is described as an interchangeable part, such that with different adapters the applicator may be suitable for different types of valves. The connection piece connects to the nozzle or trunk. During use of the container with the head down, this trunk comes down below the hand of the user. The applicator is provided with a removable safety lip for locking the handle. A drawback of this applicator is that it comprises at least 4 components which need to be produced separately and subsequently require assembly. A further drawback is that it requires an adapter which is suitable for the type of valve it is intended for, and an assembled applicator is only suitable for one type of valve. Another drawback is that the trunk comes out below the hand, which is inconvenient for an accurate aim. A further drawback is that the removal of the safety lip is irreversible. Once broken off, the security against inadvertent opening cannot be reinstalled. Another drawback is that the handheld applicator of WO 2009/147250 does not comprise a compartment for storing an accessory object, e.g. protecting gloves, useful for the user for protecting his hands against contact with the container content.

Handheld applicators for use with gun valve containers are also disclosed in U.S. Pat. No. 5,215,225, U.S. Pat. No. 5,549,226 and WO 2009/004097. These applicators however also suffer from the same disadvantages as the applicator disclosed in US 2007/0181610 A1 and discussed above in more detail.

The containers of the present invention may comprise, under pressure, compounds which are still highly reactive and react out after the compound has been applied into its final location, such as in a crevice or on to a substrate. Contact of the container content with skin, or even more importantly with eyes, is therefore to be avoided. For safety reasons, the container valve and in particular the valve stem should be shielded from being damaged, ripped off or being touched and moved relative to the valve cup. Separate caps have been designed, and the head of coupling pieces snapped on the containers may be provided with caps as seals for the valve compartment. When a gun valve container is not intended for supply with a snapped on coupling piece, but rather with a handheld applicator, sufficient provision should be provided for properly shielding the gun valve from being damaged, ripped off or being touched and moved relative to the valve cup.

There therefore remains a need for a handheld applicator for gun valve containers which provides improved ergonomics over conventional handheld use, offers the dosing and aiming capabilities comparable to those of a dispensing gun, and which may be produced simply and inexpensively as a single product in a single production step. The applicator is preferably provided with a reversible safety seal, more preferably also as an integrated part.

The present invention aims to obviate or at least mitigate the above described problem and/or to provide improvements generally.

SUMMARY OF THE INVENTION

According to the invention, there is provided an assembly of a pressure container and a handheld applicator, a process for the production of the handheld applicator and of the assembly, and corresponding uses as defined in any of the accompanying claims.

The invention provides for an assembly of a pressure container containing a composition suitable for forming a silicone paste, a polyurethane (PU) foam, or a glue, the container being closed with a container valve which is a gun valve, and a handheld applicator, suitable for applying the content present in the pressure container, characterised in that the handheld applicator comprises a fixed part for attachment to the pressure container and which fixed part further provides a grip surface for contact with the palm of the hand, thereby providing a pistol grip, the handheld applicator further comprising an integrated moveable part which provides a handle surface for an action by at least one finger of the same hand, preferably by two and more preferably by three fingers of the hand, and which further provides, by its movement, for engaging with the container valve and for opening the container valve under the action by pushing the stem of the container valve down into the container contents, preferably by a movement along the axis of symmetry of the valve stem.

We have found that the handheld applicator of the present invention offers excellent ergonomics to the user, and is extremely easy and intuitive to use for non-experienced end users. A particularly advantageous feature is that the handheld applicator provides not only for a handle surface for an action by the finger or several fingers, but also for a grip surface for contact with the palm of the hand. By having both surfaces integrated in the same applicator, it is avoided that the action on the applicator would strain the connecting attachment between the applicator and the container. This significantly and usually eliminates the risk that during the action the handheld applicator becomes unintentionally disconnected from the container, and compound would unintentionally be released in rather uncontrollable and for the user possibly dangerous directions. This brings a significant extra safety feature.

The handheld applicator offers the further advantage that it may be produced as one single piece, eliminating any complex and costly assembly steps, and therefore may be available at low cost. The applicants have further found that the handheld applicator may be designed such that the flow of compound may be controlled by putting more or less power on the applicator, and this without any adjustment screw. It was further found that the excellent ergonomics of the handheld applicator and its design may offer the user improved aiming and dosing capabilities, which broadens its suitability over a wider range of applications. The assembly may thus for instance be suitable also for the filling of smaller crevices with PU-foam, and allows reducing the amount of excess compound which is typically applied and which needs to be removed later and thus ends up as waste. This reduces the amount of aftercare work required and brings a higher efficiency in material use.

The assembly of the present invention, as compared to the disclosure in WO 2009/147250 A2, brings the advantage that the important parts of the handheld applicator are integrated, i.e. the fixed part and the moveable part, resulting in a handheld applicator which may be produced as one single piece. After production, it may thus be ready for direct assembly with the pressure container. The handheld applicator of WO 2009/147250 A2 on the other hand consists of various different parts, and requires a significant and complex assembly operation as part of the production and supply chain. In addition, the handheld applicator of WO 2009/147250 A2, seals on top of the valve stem, whereby the applicator according to the present invention preferably seals along the side of the valve stem, more preferably around the grommet or rubber of the valve, as explained below. Because the valve stem may be somewhat moved by deformation of the valve cup after closing off the container, the assembly of WO 2009/147250 A2 is more prone to unintentional and/or premature leakage of container contents, resulting in loss of useful product, extra cleaning and after care, and possibly even safety and industrial hygiene concerns.

The same problem of sealing on top of the valve stem is present in the handheld applicators disclosed in EP 850 852 A1. The applicators shown in FIGS. 1-4 also do not offer the ergonomics provided by the assembly according to the present invention. The applicator shown in FIGS. 5-8 of EP 850 852 A1 needs to be activated by pushing first grip 24, in the form of a circular push button 27, on top of the assembly with the container. This kind of assembly does not provide the ergonomics of the pistol grip which is provided by the applicator as part of the present invention, and hence does not provide the aiming and dosing accuracy which is offered by the present invention.

Also the applicator disclosed in WO 2009/004097 A1 does not provide the pistol grip which is offered by the assembly according to the present invention, and therefore cannot offer the same ergonomics, aiming and dosing accuracy which is offered by the present invention, and which resembles very closely the advantages offered by a dispensing gun which is so popular with professional users.

In another embodiment, the invention provides for a process for the production of the handheld applicator as part of the assembly according to the present invention comprising a step of injection moulding, preferably only one single step of injection moulding. The process may further comprise the step of assembling the applicator with the container.

The production process according to the present invention is simple and fast, and is able to produce the handheld applicator and the assembly at a low cost.

In a further embodiment, the invention provides the use of the assembly according to the present invention for applying the compound from the pressure container with a handheld method.

BRIEF DESCRIPTION OF THE DRAWINGS

FIG. 1 shows a preferred embodiment of the handheld applicator as part of the assembly according to the present invention.

DETAILED DESCRIPTION

Figure 1B:
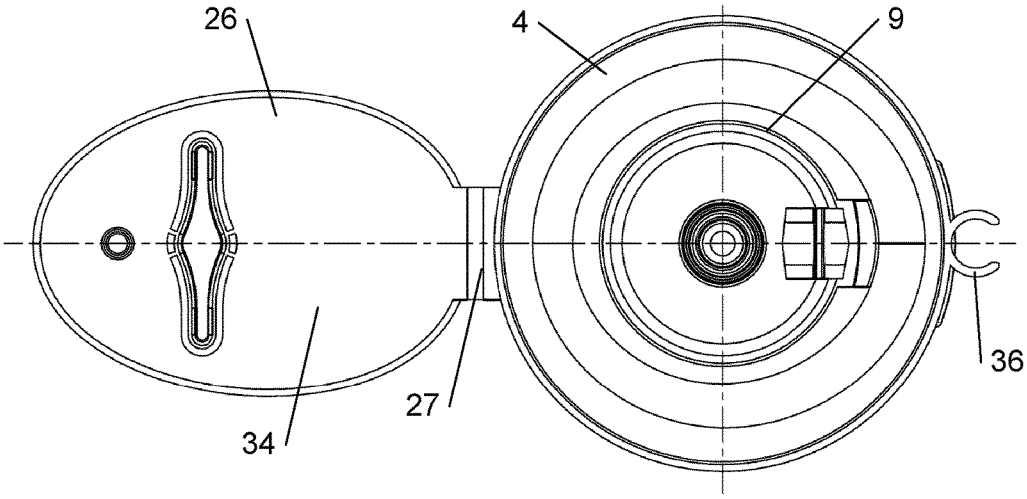
FIG. 1B shows a bottom view and FIG. 1C shows a top view of the same applicator.

The containers for compounds under pressure are typically designed as cylinders. The bottom is usually closed off by flanging a concave bottom plate onto the cylinder. The top of the cylinder is typically closed off by flanging on a convex head plate, with therein a central opening through which the container may be filled with its content. This opening is then typically closed off with a valve through which the container content may be released using the pressure which is built up inside the container. This container valve is typically also flanged onto the container head. This valve flange connection is formed by shrinking the container valve onto the container head, thereby typically at the same time closing off the container after it has been filled.

At room temperature, the pressure inside a filled and ready-to-use container is typically about 5 bar gauge. The containers are typically able to remain intact up to a pressure of 18 bar gauge, and are designed to not burst open with a pressure below 21.6 bar gauge. The valve is typically designed to resist a pressure up to at least 22 bar gauge. Other containers exist, which are only able to remain intact up to a pressure of 12 or 15 bar gauge. The container valve usually comprises a valve cup, i.e. a round metal cup which is flanged or "shrunk" at its perimeter into the central filling opening of the container, optionally in addition using a rubber seal, usually an O-ring, for preventing leakage of any content through this valve flange.

The present invention is directed to pressure containers containing a composition which is suitable for forming a silicone paste, a polyurethane (PU) foam, or a glue. These compositions have in common that they have a relatively high viscosity which may generally be as high as at least 40.000 mPa·s at 20° C., preferably even at least 60.000 mPa·s, and possibly even much higher. In addition these compounds are reactive when in contact with the environment. It is therefore important for a long shelf life of the container that the valves for use with such compositions offer a good sealing of the container from the environment. As stated in the foreword of A. De Schrijver, "Foam manual", the development of a suitable container valve, suitable for closing of containers with such reactive contents and for appropriately releasing the contents having such high viscosities, has been key to the development of substantially problem free containers for the application of PU foams, which was a major factor in the commercial success thereof. As a result of such good sealing requirement, the valves used with such compounds, and in particular the gun valves amongst them, are rather difficult to operate, and thus to open.

The present invention differentiates thus significantly from pressure containers containing a much less viscous, non reactive and often highly volatile content, such as aerosol containers, for which a very simple ball valve, or bullet valve is suitable, also possibly called a dip tube valve. Such aerosol containers, and applicators for those types of valves, are for instance disclosed in US 2009/0321381, in JP 8 169480 A, in WO 2007/149459 A2, and in JP 2000 142847 A. The applicators disclosed in these documents may be suitable for operating the easy-going ball or bullet valves which are generally used on aerosol containers. They are unable to handle and incompatible with the much better closing but thereby more difficult to operate gun valves which have especially been developed for the high viscosity and reactive fluids offered in pressure containers, such as silicone pastes, polyurethane (PU) foam compositions, and glues.

In the conventional valve design of the containers as part of the assembly of the present invention, the valve cup is supporting a central rubber grommet through which a usually plastic valve stem sticks. The stem is rigid and typically has a central duct which turns, just before the stem ends at its lower end in a blind flange, sideways into one or more, typically four, side openings. In a state at rest, the rubber grommet pulls the blind flange up against the bottom of the grommet and seals off the openings. The valve is designed for being opened by pushing the stem down relative to the grommet or cup, whereby typically the grommet deforms elastically and whereby at least one of the side openings in the valve stem becomes available for the container content.

Because the rubber of the grommet of the conventional valve, particularly when carbon black has been used as a filler in the rubber, allows diffusion of water, which then may react with certain compounds in the container to form a sticky solid, the conventional valve has the disadvantage that the valve stem may become blocked over time, or when the container has been for some time in a horizontal position. This may already occur when the container has been lying on its side for a period of only 3 to 6 weeks. A further disadvantage is that the rubber of the grommet also allows diffusion of propellant gasses out of the container, such that the container may lose most or all of its pressure after a while. For these reasons, other types of valves have been developed, which may not comprise the rubber grommet as described for the conventional valve. Such container valves may also be known as "feststof" valves, and suitable variants thereof are for instance described in WO 2009/004097, U.S. Pat. No. 5,014,887, WO 03/062092, or U.S. Pat. Nos. 5,215,225, 5,549,226 and 6,058,960. These valves have no rubber grommet, or only have a rubber grommet on the outside of the valve which is not in contact with the contents of the container. These "feststof" valves may thus be characterised in that the materials of the valve parts coming in contact with the container contents are substantially impermeable for water and/or propellant gasses. The valves may for instance be provided with one or even more than one metal spring, being a spiral spring or a leaf spring or a combination thereof. The spring or springs may be provided and tailored such that the valve may be easier to open than a conventional valve, and thus offer further improved ergonomics to the user, as well as improved aiming and dosing capabilities. The springs may also assure a faster closing of the valve as compared to the conventional valve. A valve with an internal spiral spring is for instance disclosed in U.S. Pat. No. 5,014,887. Valves with external spiral springs may be found as part of the family of valves MIKAVent PU-RF, available from Mikropakk. Valves with a blade spring may be found in U.S. Pat. No. 6,058,960, WO 03/062092 and WO 2009/004097.

Like conventional valves, these "feststof" valves typically also have a valve cup and a stem. The valve cup of such valves may still be susceptible to deformation under internal pressure inside the container. These valves are typically provided with at least one sealing section at the outside of the valve stem, suitable for forming a seal when brought in contact with a gun adaptor, a dispensing gun, or a handheld applicator. These sealing sections may comprise slats for improving the sealing function, and these slats may be provided at suitable locations on the outer surface of the valve. Examples of such slats are disclosed in U.S. Pat. No. 5,014,887, U.S. Pat. No. 6,058,960 and in WO 2009/004097.

In an embodiment of the handheld applicator as part of the assembly according to the present invention, the applicator is suitable for use with all types of gun valves. These types may thus include the conventional gun valve comprising the rubber grommet, the gun valve comprising the external grommet, the gun valve comprising an internal spiral spring, the gun valve comprising an external spiral spring, and the gun valve comprising a blade spring. The handheld applicator may therefore be provided with a plurality of sealing sections, optionally extra provided with slats. These sealing sections may be provided at the various internal surfaces which may make contact with external surfaces of any of the valves, such as for instance on the inside surfaces of the strictly cylindrical part of the receiving device, or on conical sections provided as part of the receiving device, or at the bottom of the hollow cylinder or of a receiving device having a different shape. We prefer to have at least a sealing section on the inside surface of the strictly cylindrical part of the receiving device, but we prefer even more to also provide a sealing section as part of at least one of the other internal surfaces named, and most preferably at all of the named surfaces.

The applicants have found that the handheld applicator as part of the assembly according to the present invention may also be made suitable for operating with a straw valve container. The applicator may be provided for engaging also with the stem of a straw valve, in such a way that the movement of the moveable part of the applicator results in a pushing down of the stem of the straw valve into the container contents, preferably by a movement along the axis of symmetry of the valve stem.

In an embodiment of the applicator as part of the assembly according to the present invention, the action by the hand on the applicator is a squeezing action, i.e. thereby squeezing the hand around the body of the handheld applicator. Squeezing is by far the most natural and the easiest action to be performed by one hand, and provides a strong force and the best control of the force exerted by the single hand on the applicator. This provides further improved ergonomics, aiming and dosing capabilities to the user.

In an embodiment of the applicator as part of the assembly according to the present invention, the handle surface provides a trigger cooperating with the grip surface, preferably complementing the pistol grip. This brings the advantage that the use of the assembly comprising the handheld applicator more closely resembles the use of the more sophisticated dispensing device or dispensing gun, with all its associated advantages in terms of ergonomics, aiming and dosing capabilities.

In an embodiment of the applicator as part of the assembly according to the present invention, the fixed part of the applicator further comprises an additional grip surface for contact with at least one finger, preferably for the index finger, more preferably for closing the hand around the applicator in cooperation with the thumb of the hand. This brings the resemblance with the use of a dispensing gun even closer.

In an embodiment of the applicator as part of the assembly according to the present invention, the grip surface for contact with the palm of the hand has a surface area of at least 10 $cm^2$, preferably at least 20 $cm^2$, more preferably at least 30 $cm^2$, even more preferably at least 40 $cm^2$ and most preferably at least 45 $cm^2$, typically about 50 $cm^2$, and/or the handle surface has a surface area of at least 4 $cm^2$, preferably at least 5 $cm^2$, more preferably at least 6 $cm^2$, even more preferably in the range of 7-9 $cm^2$ and typically 9 $cm^2$, preferably the grip surface for contact with the palm of the hand and/or the handle surface, more preferably at least the grip surface for contact with the palm of the hand, being provided as an at least partially rough-textured surface.

In an embodiment of the present invention, the applicator is further provided with a conveying tube for the container content to be discharged, preferably this conveying tube being provided with a connection to accommodate a trunk or hose for enabling the container content to be discharged in a well-aimed manner, whereby preferably the conveying tube and/or the trunk or hose, when connected to the connection is provided for passing in between two fingers of the hand, preferably between the index finger and the middle finger when the hand is gripping around the applicator, preferably around the pistol grip, for exerting the action. The applicants have found that this brings the advantage that the compound may be applied with a higher precision, which allows to further reduce the amount of excess compound which is typically applied and which needs to be removed later and ends up as waste. This thus further reduces the amount of aftercare work required and brings an even higher efficiency in material use.

In an embodiment of the applicator as part of the assembly according to the present invention, the moveable part is connected to the fixed part by a resilient part suitable for allowing by its reversible deformation a pivoting of the moveable part with respect to the fixed part, preferably the pivoting being around a virtual rotational axis, more preferably the virtual rotational axis being located approximately in an imaginary plane running through the point of engagement between the moveable part and the container valve and running perpendicular to the direction of movement of the stem of the valve, preferably the resilient part being provided as an integral part of the applicator. The applicants have found that this location of the resilient part relative to the stem of the valve brings the advantage that the action on the applicator, which causes the moveable part to pivot or rotate over at least a small angle relative to the fixed part, translates into a substantially linear movement of the stem of the valve straight into the container, and this with a minimum of friction between the applicator and the stem of the valve. This brings the advantage of minimizing the force to be exerted on the applicator for achieving a given opening of the valve, which further improves the ergonomics, the aiming and the dosing capabilities. We have found that this resilient part may be provided as an integrated part of the applicator, such as by a portion suitably designed to allow bending the portion which, when produced from a material having some resilience such as a plastic, may act as a resilient part by bending, thereby providing a virtual rotational axis.

In an embodiment of the applicator as part of the assembly according to the present invention, the fixed part is provided with a first cylindrical portion comprising a protruding rim for snapping the applicator onto or sliding the applicator over the valve flange of the container, as defined above being the flange connecting the valve plate to the container head, and/or a second cylindrical portion comprising a protruding rim for snapping the applicator onto or sliding the applicator over the head flange of the container, preferably onto and/or over both flanges, thereby attaching the applicator to the container. The applicants have found that by having a substantially full circular contact of the applicator with the container where it is snapped onto one of the flanges, this brings the advantage of an improved attachment of the applicator to the container, stronger as compared to an only partial contact and fully reliable in terms of fixing the relative positions of the container and the applicator. The applicants prefer to snap the applicator onto the valve flange of the container, because that flange is the smaller flange, and this attachment may thus be easiest to achieve with a minimum of construction material for the applicator, and was found to be sufficient for the purpose. However, the applicator may alternatively or in addition also be snapped onto the head flange of the container for achieving and/or improving the attachment of the two elements of the assembly.

In an embodiment of the present invention, the applicator further comprises a hollow cylinder as a receiving device for engagement with the container valve, a conveying tube for the container content to be discharged which is moveably arranged at the receiving device, whereby the conveying tube is provided for, under the action by the hand on the applicator, engaging with the stem of the valve and whereby the grommet of the valve, if present, is compressed in the direction of the engagement action on the stem and expands perpendicular to this direction and is thereby pressed against the hollow cylinder of the applicator thereby providing or tightening the seal which may preferably already exist between the valve and the receiving device of the applicator, and which seal preferably is further improved by slats provided on the outer surface of the valve and/or on the inner surface of the hollow cylinder, more preferably on both surfaces. The applicants have found that this engagement between the hollow cylinder of the applicator and the outside of the gun valve provides a seal which on the one hand protects the compound leaving the container from contact with the environment and on the other hand prohibits the compound leaving the container from unintentionally escaping or leaking sideways instead of flowing through the conveying tube which is intended for guiding the compound flow. Any slats provided as part of these seals are found to further improve the sealing function of the sealing sections.

In an embodiment of the applicator as part of the assembly according to the present invention, the receiving device is flexibly connected with the conveying tube such that by the action on the applicator the conveying tube is vertically displaced relative to the receiving device, preferably the flexible connection being with a shoulder on the conveying tube and/or the flexible connection being by means of a membrane, thereby facilitating the movement of the conveying tube in the direction of the valve and closing off one end of the hollow cylinder, most preferably the flexible connection and/or the membrane being provided as an integral part of the applicator. The applicants have found that, in particular when the membrane is made of a material which is impermeable for fluids and gasses such as air, this provides the advantage of further sealing the compound leaving the container from contact with the environment, and of further prohibiting unintentional leakage of compound.

In an embodiment of the present invention, the applicator further comprises a safety seal for securing the relative position of the moveable part relative to the fixed part, wherein preferably the safety seal is provided for being moved and for requiring its move for enabling the action on the handle surface to open the valve, preferably the safety seal being provided as an integral part of the applicator and/or the seal being provided as a rigid part fixing in a closed position of the safety seal the position of the moveable part relative to the fixed part of the applicator. This brings the advantage that any unintended action on the applicator prior to moving the safety seal from its safe or closed position does not cause any premature or unintended release of compound from the container. The applicants have found that such a safety seal may be provided as an integral part of the applicator, such that the applicator including its safety seal may be produced by a single injection moulding production step.

In an embodiment of the present invention, the safety seal is provided for reversible movement, preferably being movable around a hinge joint connecting the safety seal to the fixed part, more preferably the safety seal and/or the hinge joint, and most preferably both, being provided as an integral part of the applicator, preferably an integral part of the fixed part of the applicator. This brings the advantage that the safe or closed position of the safety seal may be restored after a use of compound, such that the assembly becomes again protected from any premature or unintended release of compound from the container. The applicants have found that such a safety seal and if present also its hinge joint may be provided as integral parts of the applicator, such that the applicator including its safety seal and the hinge joint thereof may still be produced by a single injection moulding production step.

In an embodiment of the present invention, the moveable part of the applicator is provided with a first means and the safety seal is provided with a second means for engaging with the first means and by this engagement securing the moveable part from moving relative to the fixed part. This brings the advantage that the safety seal is well connected to the moveable part, and thus is more effective in securing the relative position of the moveable part relative to the fixed part of the applicator. The applicants prefer the first means to be a leg or circular protrusion and the second means to be a slot or hollow cylindrical protrusion, suitable for receiving and preferably clicking in the leg or circular protrusion. This provides for a strong connection, which also may be opened and closed more than once, preferably several times.

In an embodiment of the present invention, the safety seal is further provided with a first means, preferably a protrusion, more preferably at least part of a protruding rim, for engagement with a second means provided as part of the fixed part for cooperation with the first means, preferably the second means being a receiving surface on the fixed part fitting the part of the protruding rim on the safety seal, and by their engagement further securing the position of the safety seal relative to the fixed part. The hinge joint of the safety seal, when provided as an integral part of the applicator made of a resilient plastic material, is a relatively weak part of the applicator, and is more prone to breaking. The advantage of this embodiment is that the function of the safety seal is not anymore dependent on the integrity of the hinge joint, but may still perfectly function when the hinge joint has been broken. This is of particular interest when the same container is used several times with intervals between applications of small amounts of compound.

In an embodiment of the present invention, the applicator further comprises a cavity for providing an accessory object, the cavity preferably being closed with a cover, the accessory object preferably comprising one glove, more preferably a pair of gloves, suitable for protecting one or both hands of the user of the pressure container against contact with the component from the container, the glove or gloves optionally being folded and/or individually or collectively wrapped. This brings the advantage that together with the assembly of the container and the applicator according to the present invention, an accessory object may be supplied which may be of possible interest to the user or the consumer. This accessory object may for instance be an information carrier, e.g. containing more information than for which there is room available on the external surfaces of the container or of the applicator. Such information may for instance be safety information related to appropriate use of the container and/or its contents, and may e.g. be in a different language than similar information provided on the container. The accessory object may for instance be one or a pair of plastic gloves suitable for allowing the user to protect his hands against contact with the container contents. These gloves are preferably folded and wrapped. The accessory object may also be a toy.

In an embodiment of the present invention wherein a safety seal is present, the safety seal is provided as the cover for closing off the cavity for the accessory object. The applicants have found this to be a very convenient way to combine preferred features of the applicator according to the present invention. It brings the advantage that the accessory object becomes available immediately before use of the container, which is particularly suitable for protecting gloves. If the safety seal can be reclosed such as in some of the preferred embodiments, the gloves may be restored into the cavity, such that they are stored together with the used container and remain readily available to the user for during his next use.

In an embodiment of the present invention, the applicator is further provided with a closure element suitable for closing the open end of a trunk or hose which is optionally provided together with the applicator and which is preferably connectable or connected to connection, if present, and be accommodated for enabling the container content to be discharged in a well-aimed manner, the closure element preferably being provided as an integral part of the applicator, more preferably as an integral part of the safety seal, the closure element preferably being provided for being broken off, more preferably further comprising at least one suitable handling surface for easy handling of the closure element. This brings the advantage that the compound which after use remains inside the applicator may be sealed from influence from the environment, and may remain in a fresh and fluid condition. This is particularly advantageous when the compound is moisture sensitive and may harden in a reaction with water, such as with one component PU-foam. The applicants have found that correct use of such closure element allows a PU foam compound to flow again out of the can or container and through the handheld applicator, which is air tight apart from the trunk tip, as much as 48 hours after a previous use.

In an embodiment of the present invention, the applicator comprises an external flat surface, preferably this surface being located on top of the applicator or on top of the safety seal or on top of the cover of the cavity for the accessory object. This brings the advantage that the applicator may readily be picked up by means of a vacuum applied through a suction cup engaged with this external flat surface during assembly of the applicator with the container, and be released by breaking the vacuum.

In an embodiment of the present invention, the applicator is made from nylon 6, polypropylene (PP), high density polyethylene (HDPE), polyamide (PA), polycarbonate (PC) or acrylonitrile butadiene styrene rubber (ABS), or mixtures thereof. The applicants have found that such plastic materials provide sufficient strength together with sufficient resilience in order to provide all essential and desirable parts of the applicator as integral or integrated parts thereof, and that by a suitable mould design, the applicator may be produced as a single product in a single step of injection moulding. The applicants have found that with these materials of construction, by adapting design and material thicknesses of the various parts, those parts of the handheld applicator which need to be flexible and/or resilient may be formed as flexible and/or resilient parts, and those parts which need to be rigid may be formed as rigid parts.

In an embodiment of the assembly according to the present invention, the container valve is a so called "feststof valve", i.e. a valve comprising in contact with the container contents only materials having little to no permeability for water and/or propellant gasses, such as rigid plastic and/or metal but no rubber parts, in particular no parts made of carbon black filled rubber, and preferably the assembly provides a seal between the valve and the receiving device of the applicator, which seal preferably is further improved by slats provided on the outer surface of the valve and/or on the inner surface of the hollow cylinder, more preferably on both surfaces. These "feststof" valves may also be characterised in that the materials of the valve parts coming in contact with the container contents are substantially impermeable for water and/or propellant gasses. The valves may for instance be provided with at least one metal spring, and may thus be easier to open and faster closing, and a.o. offer further improved ergonomics to the user and improved aiming and dosing capabilities. Their other advantages have already been discussed above. A further advantage is that these valves are less prone to deformation from internal pressure inside the container, in particular when the container is closed off and internal pressure and temperature builds due for instance to chemical reactions inside the container. This means that there is less risk for the valve stem being moved from its initial position, thereby reducing the risk that the valve stem is not anymore in the optimum position suitable for the handheld applicator of the present invention.

In another embodiment, the assembly according to the present invention further comprises a trunk or hose which is preferably connectable or connected to the connection, if present, and suitable for enabling the container content to be discharged in a well-aimed manner, preferably wherein the trunk or hose is clicked into a clips which is provided as part of the applicator and/or the container, optionally the trunk or hose being made from resilient material and being bent or folded in the clicked-in position, preferably such that by releasing the trunk or hose from the clips, the trunk or hose extends into its unbent or unfolded position, which preferably is the position of the trunk or hose ready for use. This trunk further complements the assembly with the elements which the user expects to need for applying the compound in the container. The preferred embodiments are very convenient for storage and transportation of the assembly from its production location through the distribution chain and to the consumer.

In an embodiment of the assembly according to the present invention, the assembly further comprises an accessory object, which preferably is provided in the cavity for providing the accessory object, if present. Such accessory object may for instance be at least one and preferably a pair of gloves suitable for protecting human skin against contact with the content of the container. This is of particular interest in case the container comprises methylene diphenyl diisocyanate (MDI) in a reactive form.

In another embodiment of the assembly according to the present invention, the gun valve container contains a composition suitable for forming a polyurethane (PU) foam.

The invention further provides for the process for producing the applicator as part of the assembly according to the present invention comprising the step of injection moulding. In an embodiment thereof, the process further employs a mould comprising at least 4 parts which are able to move relative to each other, preferably perpendicularly and/or parallel to each other, for closing and opening the mould, preferably only 4 parts.

In another embodiment of the process according to the present invention, the mould further comprises one or two cores for shaping at least one opening internal to the handheld applicator, such as the conveying tube or the hollow cylinder. This process enables the applicator to be produced as one single product with all essential and desired elements as integral parts thereof, and in one single production step.

In another embodiment, the process according to the present invention further comprises the step of assembling the applicator with the container. We thereby prefer to provide means for assuring that the applicator does not tilt with respect to the container, or means for assuring the alignment of the applicator with respect to the container. This may for instance be achieved by specific guides or by the insertion of a "leading head" into the applicator during the assembly step, such that its alignment remains secured and tilting is avoided.

In another embodiment of the process according to the present invention, the applicator is picked up by means of a vacuum applied through a suction cup engaged on the external flat surface provided on the applicator, preferably on top of the cover closing off the cavity for the accessory object, and whereby the applicator is released by breaking the vacuum after the applicator having been brought into a position on the container which position is suitable for the applicator being snapped onto the container.

The present invention is further illustrated by the accompanying drawings.

FIG. 1 shows different views of a preferred embodiment of the handheld applicator 1 according to the present invention. FIG. 1A shows a side view, FIG. 1B shows the bottom view and FIG. 10 shows a top view of the same applicator. FIG. 1D shows a cross sectional view according to the $I_D$ arrows indicated in FIG. 1A, and FIG. 1E shows a cross sectional view according to arrows $I_E$ indicated in FIG. 1A. Handheld applicator 1 is intended for snapping on top of a container (not shown) to form an assembly, which during use is turned upside down with the container above the applicator. The applicator comprises a fixed part 4, with grip surface 5 for contact with the palm of the hand of the user. The applicator further comprises integrated moveable part 6, with handle surface 7, thereby offering a trigger cooperating with the grip surface 5 to form a pistol grip, suitable for a squeezing action by one hand, i.e. by closing one or two fingers towards the palm of the hand which is in contact with grip surface 5. Fixed part 4 further comprises grip surface 8 for contact with the index finger, such that the index finger in cooperation with the thumb of the hand may close a firm grip around the fixed part 4 of the applicator.

Figure 1A:
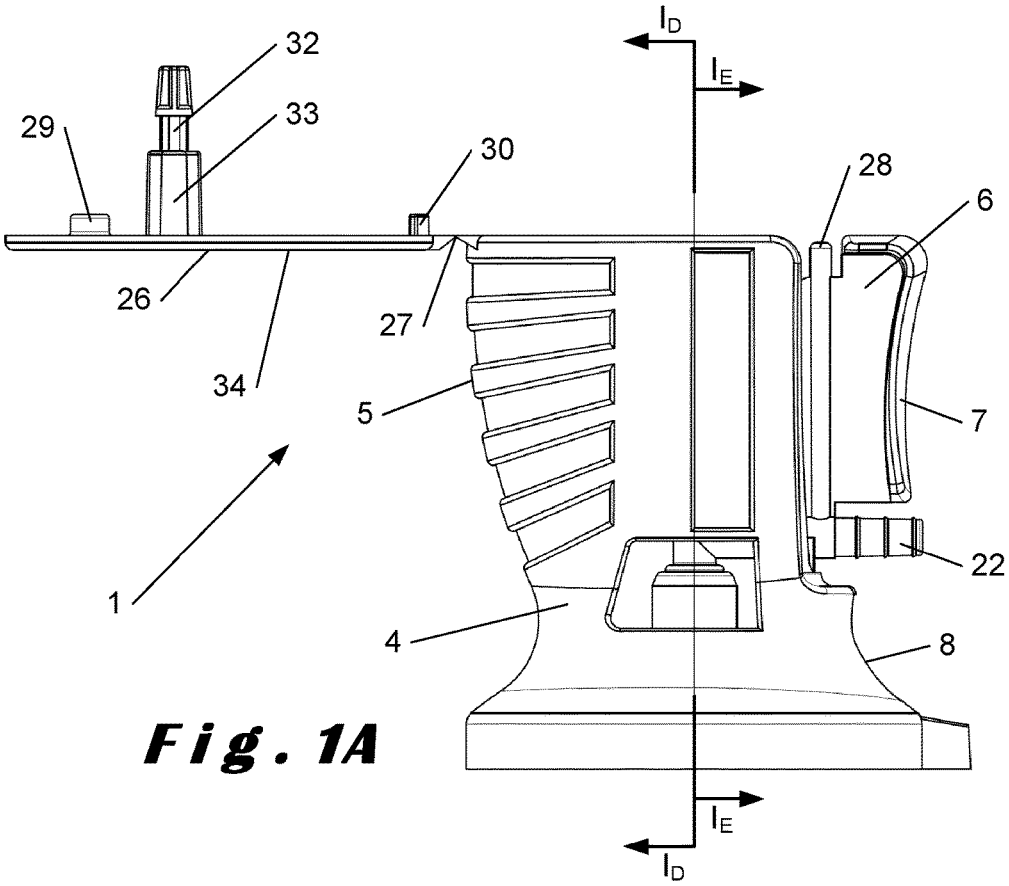
FIG. 1A shows a side view.
Figure 1C:
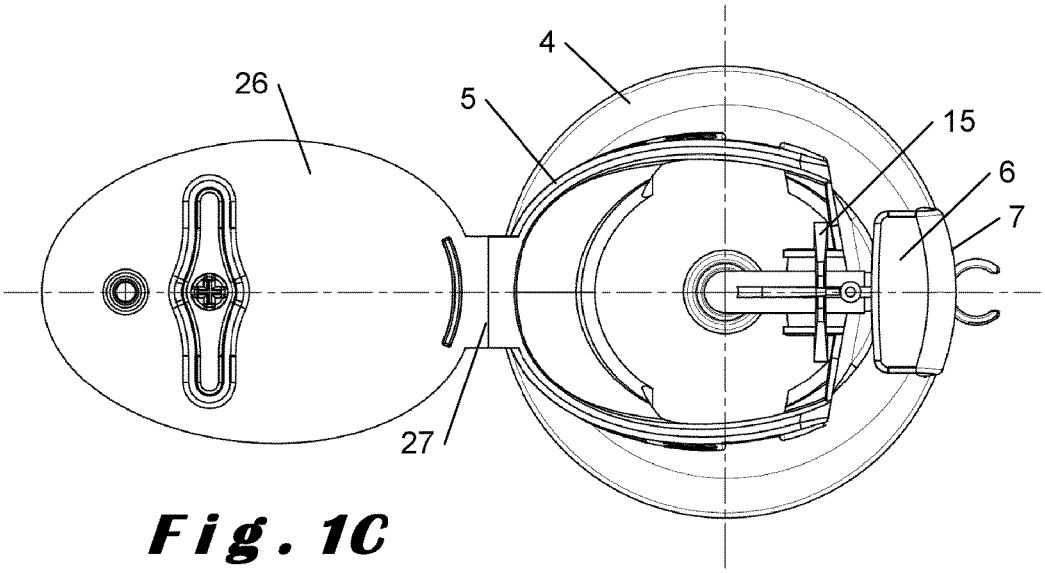

Further shown on FIG. 1A is connection 22 for connecting the hose for aiming the container compound. Also shown is safety seal 26, integrated with the fixed part of the applicator via hinge joint 27 and provided for reversible movement, the safety seal being provided with second means 29 for engaging with first means 28 provided on the moveable part 6, and thereby securing the moveable part 6 from moving relative to the fixed part 4. Preferably, the second means 29 is provided with an internal conical shape and/or the first means 28 is provided with an external conical shape, such that when closing the safety seal 26, the first and the second means more readily find each other for engaging with each other and securing the moveable part 6 relative to the fixed part 4. The inventors have found that it is beneficial that safety seal 26 is provided with a lip or an ear, such as extending sideways from the perimeter of the seal 26, preferably at a location substantially opposite of the hinge joint 27. This provides an extra handling point which facilitates the opening or reopening of the safety seal 26 when secured into position of safety. Further shown is protrusion 30 on the safety seal 26 for additional security as explained later. Integrated with safety seal 26 is also closure element 32, provided for being broken off, and provided with suitable handling surface 33 for easy handling. Also indicated is flat surface 34, as part of the safety seal, which may be helpful in assembling the handheld applicator with a container.

In the bottom view of FIG. 1B, protruding rim 9 is shown for snapping the fixed part 4 of the applicator onto the valve flange of a container. Also clearly shown is safety seal 26 connected to fixed part 4 via hinge joint 27, as well as clips 36 for receiving a trunk or hose. Also again indicated is flat surface 34 as part of the safety seal. In addition, the inventors prefer to provide the words "OPEN" on the flat surface 34, preferably close to second means 29, clearly indicating to the user how he should open the safety seal, have access to the accessory object, and be able to operate the handheld applicator.

In the top view of FIG. 10 are indicated fixed part 4 with grip surface 5 for the hand palm, and moveable part 6 with trigger surface 7 for the fingers. Further is indicated the resilient flat part which forms pivot joint 15, connecting fixed part 4 with moveable part 6 of the applicator, all provided as integrated parts of one single product. Further shown are safety seal 26 connected to fixed part 4 via hinge joint 27, all again as integral parts.

Figure 1D:
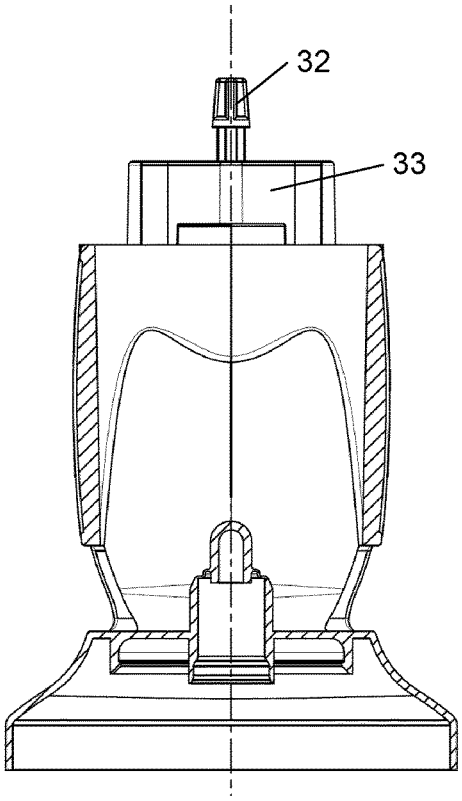
FIG. 1D shows a cross sectional view according to the $I_D$ arrows in FIG. 1A.

In the cross sectional view of FIG. 1D is shown closure element 32 with handling surface 33. In the cross sectional view of FIG. 1E are shown moveable part 6 and fixed part 4 and the resilient flat part which forms pivot joint 15 connecting the two.

Figure 1E:
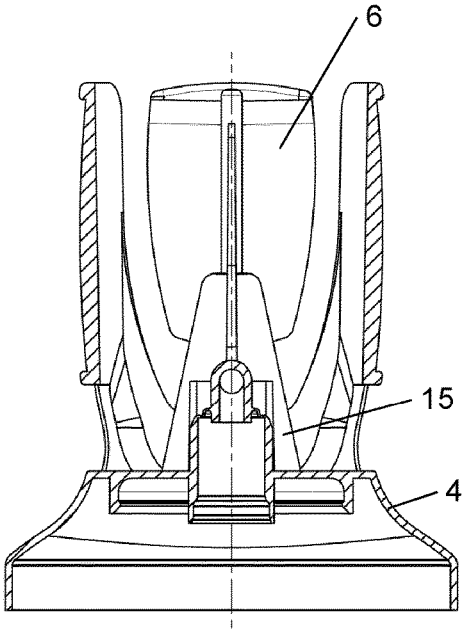
FIG. 1E shows a cross sectional view according to arrows $I_E$ in FIG. 1A.
Figure 2:
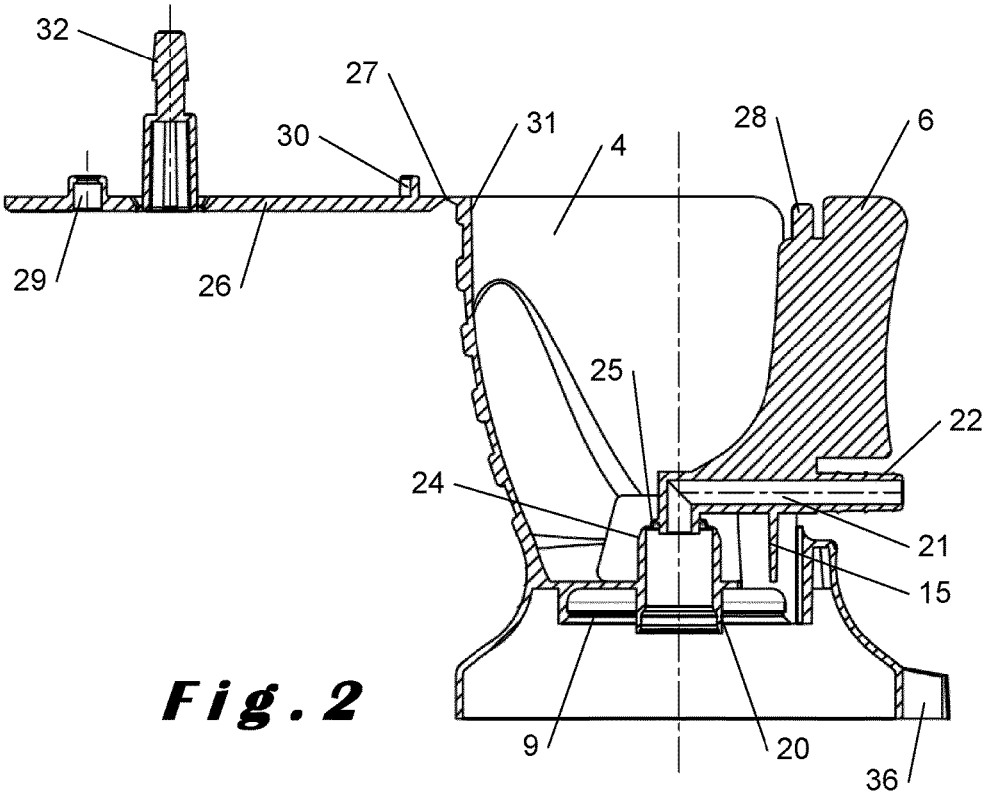
FIG. 2 shows a cross sectional view through the centre axis of the applicator and perpendicular to the cross-sectional views in FIGS. 1D and 1E, with the safety seal in the same open position as in FIG. 1A.

FIG. 2 shows a cross sectional view cut by a plane through the centre axis of the applicator and perpendicular to the cross-sectional views in FIGS. 1D and 1E, with the safety seal in the same open position as in FIG. 1A. Indicated is protruding rim 9 for snapping the applicator onto the container. The flat resilient part forming the pivot joint 15 between fixed part 4 and moveable part 6 is also shown. Further are indicated hollow cylinder 20 forming the receiving device of the applicator, which has a shoulder 24 which is connected by means of integrated membrane providing a flexible connection to conveying tube 21 ending up in connection 22 for accommodating a trunk or hose. Also shown is safety seal 26, connected via hinge joint 27 as an integral part to the fixed part 4 of the applicator and around which is able to rotate. The closure element 32 is still shown in its original position. Further indicated are leg 28 as first means provided on the moveable part 6, and hollow cylindrical protrusion 29 as second means provided on the safety seal, the leg suitable for clicking into cylinder 29. Further shown is protruding rim 30 on the safety seal 26, for engaging with receiving surface 31 on the fixed part of the applicator. Further indicated is clips 36 for receiving the trunk or hose during storage and transportation.

Figure 3:
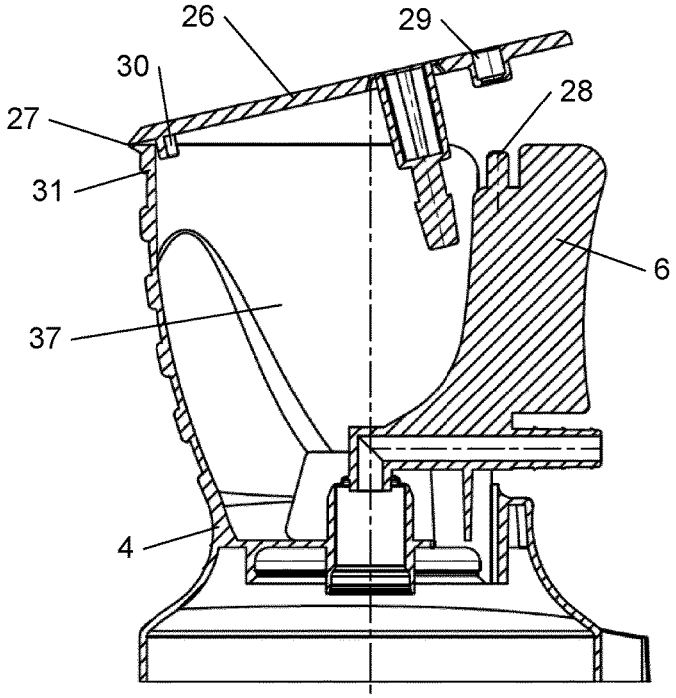
FIG. 3 shows the same cross sectional view as in FIG. 2, now with the safety seal in an almost closed position.

In FIG. 3, the safety seal 26 is shown in an almost closed position, with cylindrical protrusion 29 approaching leg 28 on the moveable part 6 and protruding rim 30 approaching receiving surface 31 on the fixed part 4. By engagement between parts 28 and 29 on the side of the moveable part 4, in combination with hinge joint 27 connecting safety seal 26 to fixed part 4, the safety seal 26 connects and secures the relative positions of moveable part 6 and fixed part 4. In addition, by engagement of parts 30 and 31 on the side of the fixed part, the security remains provided even when hinge joint 27 would have been broken, e.g. by frequent use. The inventors preferably add more sections of a protruding rim, similar to protruding rim 30, for upon closing of the safety seal 26 engaging with corresponding sections of the inside rim of the cavity of the applicator. The inventors prefer to provide such extra rim sections on both sides of the closure element 32, close to the perimeter of the safety seal 26. By closing the safety seal 26, this seal acts as a cover closing the cavity provided between moveable part 6 and fixed part 4, the cavity 37 being available for providing an accessory object, as desired, such as a pair of protecting gloves for the user.

FIG. 4 shows again a cross sectional view, as in FIGS. 2 and 3, but now of an assembly of the same handheld applicator 1 and a pressure container 2, with the safety seal of the applicator in the closed position, closing off the cavity 37 for the accessory object. Further is a hose 35 connected to the applicator, and bent into its position clicked-into its clips and extending alongside the container wall, most suitable for during storage and transportation. The applicator 1 is snapped onto valve flange 10 of the container and held in place by protruding rim 9. The bottom of the applicator 1 also grips around container head flange 12, but here without any extra snapping rim. In order to facilitate the assembly step of the applicator with the container, i.e. to stabilise the applicator on top of the container before it is snapped thereon, stabilising pins may be provided as part of the applicator at the cylindrical parts which snap on or grip around the valve flange and/or the container head flange. For further details about such stabilising pins, reference is made to co-pending patent application EP-A-10164927.5.

Figure 4:
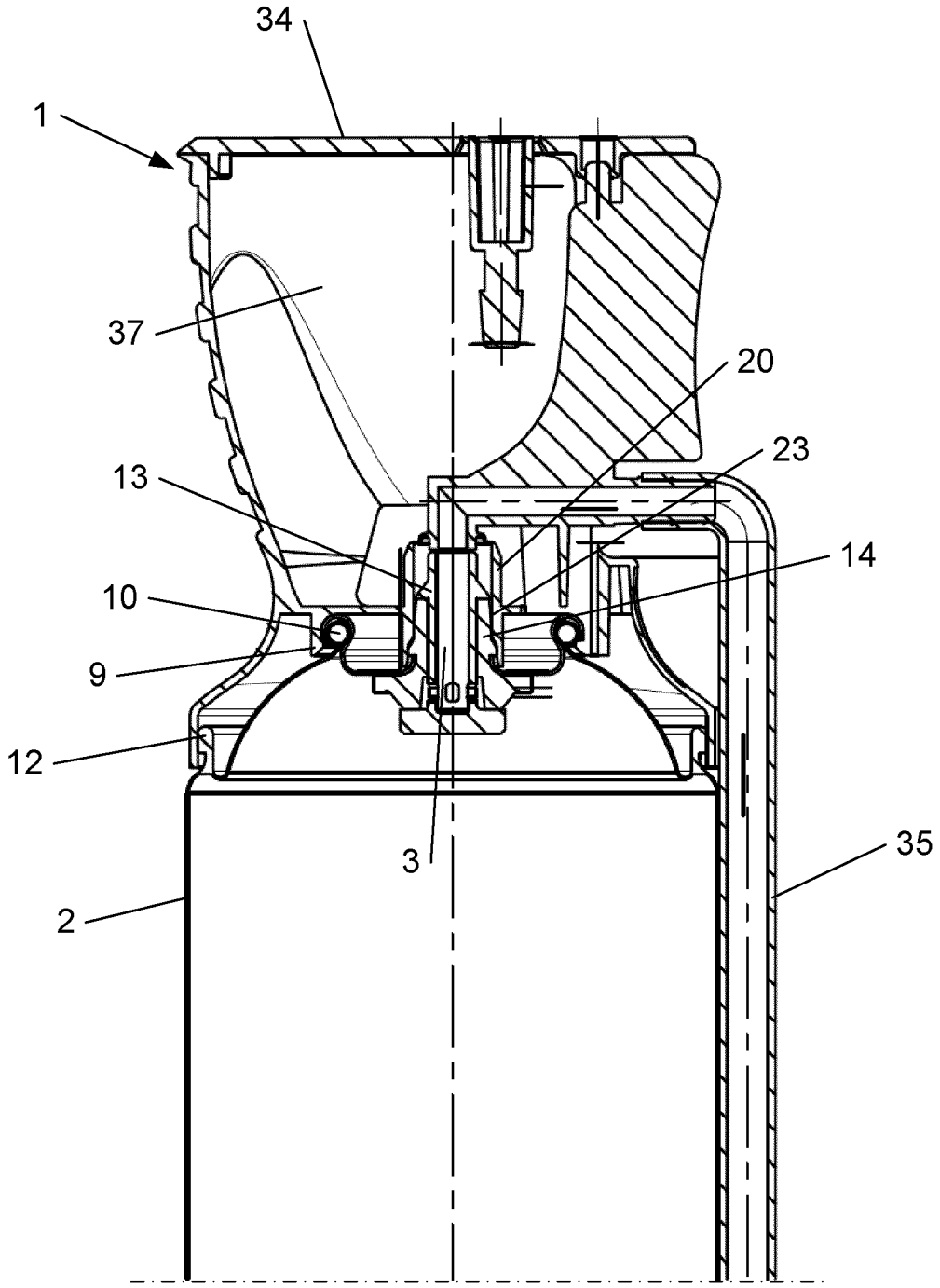
FIG. 4 shows a cross sectional view, as in FIGS. 2 and 3, of the assembly of the same handheld applicator and the pressure container, with the safety seal of the applicator in the closed position and with a hose connected to the applicator, the hose being bent into its position clicked-into its clips and extending alongside the container wall.

Of the container in FIG. 4 is also shown conventional gun valve 3, with grommet 14 holding in place central stem 13 and providing already a seal 23 against the inner wall of hollow cylinder 20, which is further tightened when the conveying tube, under the squeezing action on the moveable part 6 presses down the valve stem 13 and compresses grommet 14 vertically such that it expands laterally against the receiving device 20. With the closed safety seal, the flat surface 34 thereof is brought externally on top of the handheld applicator, in a suitable position for being helpful in the assembly step of the handheld applicator with a container.

Figure 5:
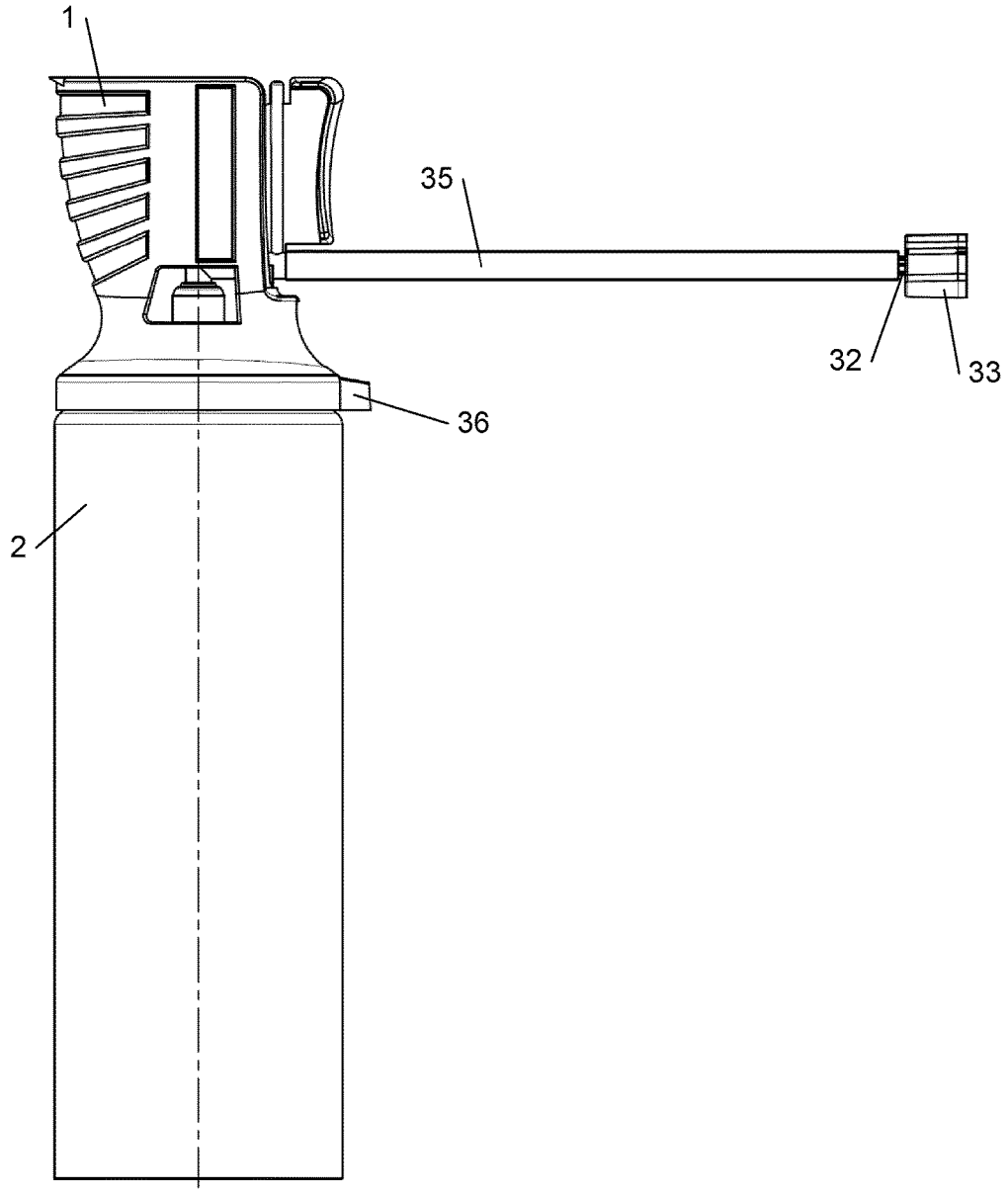
FIG. 5 shows the assembly as after a first use, with the safety seal broken off and the hose extending in its position ready for use and closed off with the closing element.

FIG. 5 shows the assembly of handheld applicator 1 with container 2, as after a first use, with the safety seal broken off and the hose 35 released from clips 36 and extending in its position ready for use. The free tip of hose 35 is shown closed off with the closing element 32, which is easy to handle thanks to handling surface 33. The inventors further prefer to provide the closure element 32 with a screw thread tip for insertion into the hose 35, such that it is readily recognizable to the user what the purpose is of closure element 32, and facilitating its insertion into the hose 35.

Having now fully described this invention, it will be appreciated by those skilled in the art that the invention can be performed within a wide range of parameters within what is claimed, without departing from the spirit and scope of the invention. As understood by those of skill in the art, the overall invention, as defined by the claims, encompasses other preferred embodiments not specifically enumerated herein.

The invention claimed is:

1. An assembly of a pressure container containing a curable composition suitable for forming a product selected from a silicone paste, a polyurethane (PU) foam, a glue, and combinations thereof, the container being closed with a container valve which is a gun valve comprising a valve cup supporting a central rubber grommet through which sticks a valve stem having an axis of symmetry, and a handheld applicator, suitable for applying the content present in the pressure container, characterised in that the handheld applicator consists of a fixed part for attachment to the pressure container and which fixed part further provides a grip surface for contact with the palm of the hand, the fixed part providing a pistol grip to the user during use of the assembly, during which use the assembly should be turned upside down with the container above the applicator, the handheld applicator further consisting of an integrated moveable part which provides a handle surface for an action by at least one finger of the same hand and the moveable part having a conveying tube for the container content to be discharged, a resilient part having a pivot joint along an axis of rotation for connecting the moveable part to the fixed part and allowing for relative movement of the moveable part, and which moveable part further provides movement, for engaging the conveying tube with the valve stem of the container valve and for opening the container valve under the action by pushing the valve stem of the container valve down into the container contents, by a substantially linear movement of the valve stem along the axis of symmetry of the valve stem straight into the container, wherein the moveable part pivots around the axis of rotation located in a plane running through a point of engagement between the conveying tube and the valve stem and running perpendicular to the direction of linear movement of the valve stem, wherein the fixed part of the applicator is further provided with a hollow cylinder as a receiving device which is engaging with the side of the grommet of the container valve, thereby forming a seal around the grommet of the gun valve, and the conveying tube, which is moveably arranged at the receiving device, is provided for, by the action, engaging with the valve stem, thereby compressing the grommet of the gun valve in the direction of the linear movement on the valve stem, the grommet expanding perpendicular to this direction and thereby being pressed against the hollow cylinder thereby tightening the seal between the side of the grommet of the gun valve and the receiving device of the applicator.

2. The assembly according to claim 1 wherein the action is a squeezing action.

3. The assembly according to claim 1 wherein the handle surface provides a trigger cooperating with the grip surface.

4. The assembly according to claim 1 whereby the fixed part of the applicator further comprises an additional grip surface part for contact with at least one finger.

5. The assembly according to claim 1 whereby the grip surface for contact with the palm of the hand has a surface area of at least 10 $cm^2$.

6. The assembly according to claim 1 whereby the handle surface has a surface area of at least 4 $cm^2$.

7. The assembly according to claim 1 whereby the resilient part is connected to the moveable part above the pivot joint and is connected to the fixed part at and below the pivot joint, whereby a reversible deformation of the resilient part allows the pivoting of the moveable part with respect to the fixed part.

8. The assembly according to claim 1 wherein the container comprises a head which is flanged to the container by a head flange, wherein the container valve is flanged to the container head by a valve flange, wherein the fixed part of the applicator is provided with a first cylindrical portion comprising a protruding rim for an operation selected from snapping the applicator onto the head flange of the container and sliding the applicator over the valve flange of the container, and combinations thereof, thereby attaching the applicator to the container.

9. The assembly according to claim 8 wherein the fixed part of the applicator is provided with a second cylindrical portion comprising a protruding rim for an operation selected from snapping the applicator onto the head flange of the container, sliding the applicator over the head flange of the container, and combinations thereof, thereby attaching the applicator to the container.

10. The assembly according to claim 1 wherein the container comprises a head which is flanged to the container by a head flange and wherein the fixed part of the applicator is provided with a second cylindrical portion comprising a protruding rim for an operation selected from snapping the applicator onto the head flange of the container, sliding the applicator over the head flange of the container, and combinations thereof, thereby attaching the applicator to the container.

11. The assembly according to claim 1 wherein the applicator is further comprising a safety seal for securing the relative position of the moveable part to the fixed part, and a hinge which is attached to the safety seal and allows for relative rotational movement of the safety seal between a closed position and an open position such that the safety seal is provided for reversible movement.

12. The assembly according to claim 11 wherein the moveable part of the applicator is provided with a first means and the safety seal is provided with a second means for engaging with the first means and by this engagement securing the moveable part from moving relative to the fixed part.

13. The assembly according to claim 11 wherein the safety seal is further provided with a first means for engagement with a second means provided as part of the fixed part for cooperation with the first means and by their engagement further securing the position of the safety seal relative to the fixed part.

14. The assembly according to claim 1 wherein the applicator is further comprising a cavity for providing an accessory object.

15. The assembly according to claim 14 wherein a safety seal is present and the safety seal is provided as the cover for closing off the cavity for the accessory object.

16. The assembly according to claim 1 wherein the applicator is further provided with a closure element suitable for closing the open end of an element selected from a trunk and a hose.

17. The assembly according to claim 1 further comprising an element selected from a trunk and a hose which is provided together with the applicator, and is accommodated for enabling the container content to be discharged in a well-aimed manner.

18. The assembly according to claim 1 wherein the applicator is further provided with an external flat surface.

19. The assembly according to claim 18 wherein the flat surface is provided on a location selected from on top of the applicator, on top of the safety seal, on top of the cover of the cavity for the accessory object, or a combination thereof.

20. The assembly according to claim 1 wherein the applicator is made from a material selected from nylon 6, polypropylene (PP), high density polyethylene (HDPE), polyamide (PA), polycarbonate (PC) or acrylonitrile butadiene styrene rubber (ABS), and mixtures thereof.

21. The assembly according to claim 1 wherein the container valve is a so called "feststof valve", i.e. a valve comprising in contact with the container contents only materials having little to no permeability for a compound selected from water and propellant gasses.

22. The assembly according to claim 21, wherein the valve comprises in contact with the container contents materials selected from rigid plastic, metal, and combinations thereof, but no rubber parts, in particular no parts made of carbon black filled rubber.

23. The assembly according to claim 1 further comprising a hose which is suitable for enabling the container content to be discharged in a well-aimed manner.

24. The assembly according to claim 1 further comprising an accessory object.

25. The assembly according to claim 24 wherein the accessory object is at least one glove suitable for protecting human skin against contact with the content of the container.

26. The assembly according to claim 1 wherein the container contains a composition suitable for forming a polyurethane (PU) foam.

27. A process for the production of the assembly according to claim 1 comprising a step of injection moulding for producing the handheld applicator, further comprising the step of assembling the applicator with the container.

28. The process according to claim 27 wherein the mould of the injection moulding comprises at least 4 parts which are able to move relative to each other, for closing and opening the mould.

29. The process according to claim 28 wherein the mould further comprises at least one core for shaping at least one opening internal to the handheld applicator, such as the conveying tube or the hollow cylinder.

30. The process according to claim 27 whereby in assembling the applicator with the container the applicator is picked up by means of a vacuum applied through a suction cup engaged on the external flat surface provided on the applicator, and whereby the applicator is released by breaking the vacuum after the applicator having been brought into a position on the container which position is suitable for the applicator being snapped onto the container.

31. A method for applying a compound from a pressure container employing the assembly according to claim 1 for applying the compound from the pressure container of the assembly with a handheld method.

32. The assembly according to claim 1 wherein the receiving device is flexibly connected with the conveying tube such that by the action on the applicator the conveying tube is vertically displaced relative to the receiving device.

33. The assembly according to claim 1 wherein the seal between the hollow cylinder and the grommet is further improved by slats provided on at least one of the outer surface of the valve and the inner surface of the hollow cylinder.

34. The assembly according to claim 1 wherein the hollow cylinder that forms the receiving device has a shoulder at one end of the cylinder, and the applicator includes a membrane disposed on the shoulder for flexibly connecting to the conveying tube.

* * * * *